US006293646B1

(12) United States Patent
Beachnau Hood et al.

(10) Patent No.: US 6,293,646 B1
(45) Date of Patent: Sep. 25, 2001

(54) INK-JET LOOK-AHEAD SERVICING

(75) Inventors: Dawn M. Beachnau Hood, Portland, OR (US); Barbara H. Rider, Camas, WA (US); Bryan S. Talbot, San Diego, CA (US); Bret K. Taylor, Vancouver, WA (US); Jefferson P. Ward, Brush Prairie, WA (US); Marc A. Yousey, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/344,321

(22) Filed: Jun. 24, 1999

(51) Int. Cl.[7] ..... B41J 2/165
(52) U.S. Cl. ..... 347/23
(58) Field of Search ..... 347/23, 14, 24

(56) References Cited

U.S. PATENT DOCUMENTS 5,798,773 * 8/1998 Hiramatsu et al. ..... 347/19
5,847,726 * 12/1998 Hori ..... 347/23
5,850,237 * 12/1998 Slade ..... 347/23

FOREIGN PATENT DOCUMENTS 0 704 307 4/1996 (EP) .
0 732 212 9/1996 (EP) .

OTHER PUBLICATIONS

U.K. Patent Office, Search Report, Nov. 23, 2000.

* cited by examiner

*Primary Examiner*—John Barlow
*Assistant Examiner*—Blaine Mouttet

(57) ABSTRACT

Document characteristics such as print media and selectable print quality variations are used to determine printhead servicing, e.g., service spitting of ink-jet nozzles. If the next sweep contains the next color in the pen or printhead set, and the next sweep would be greater than the number of sweeps since the last firing of that color ink—whether on page or at the service station—and the last sweep did not fire droplets of the color, a decap service spit and nozzle firing tracking reset is triggered. All service calls spit fire all nozzles, so all timer values are reset whenever at a service spit. Reaching or exceeding a fail-safe limit similarly triggers a decap service spit or other known manner service station operations.

32 Claims, 5 Drawing Sheets

| PAPER TYPE | QUALITY MODE | CARRIAGE SPEED (IPS) | 8" SWEEP TIME | # UNIDI SWEEPS SINCE LAST SPIT K | C | M | Y | DECAP TIMEOUT TIMER(S) | DECAP TIMES(S) K | C | M | Y |
|---|---|---|---|---|---|---|---|---|---|---|---|---|
| PLAIN | ECONO | 40 | 0.20 | 150 | 60 | 60 | 50 | 60 | 30 | 12 | 12 | 10 |
| | NORMAL | 20 | 0.4 | 25 | 20 | 20 | 10 | 30 | 10 | 8 | 8 | 4 |
| | BEST | 20 | 0.4 | 15 | 15 | 15 | 7 | 20 | 6 | 6 | 6 | 3 |
| | | | | | | | | | | | | |
| PHOTO | NORMAL | 20 | 0.4 | 25 | 20 | 20 | 10 | 30 | 10 | 8 | 8 | 4 |
| | BEST | 20 | 0.4 | 25 | 15 | 15 | 7 | 20 | 6 | 6 | 6 | 3 |
| | 2400 DPI | 10 | 0.8 | 5 | 3 | 3 | 2 | 14 | 4 | 3 | 3 | 2 |
| | | | | | | | | | | | | |
| COATED (SPECIAL) | NORMAL | 20 | 0.4 | 25 | 20 | 20 | 10 | 30 | 10 | 8 | 8 | 4 |
| | BEST | 10 | 0.8 | 7 | 7 | 7 | 3 | 20 | 6 | 6 | 6 | 3 |
| | | | | | | | | | | | | |
| TRANSPARENCY | NORMAL | 20 | 0.4 | 25 | 20 | 20 | 10 | 30 | 10 | 8 | 8 | 4 |
| | BEST | 20 | 0.4 | 15 | 15 | 15 | 7 | 20 | 6 | 6 | 6 | 3 |
| 303 | 305 | 307 | | 301 | | | | 311 | 309 | | | |

FIG.3

INK-JET LOOK-AHEAD SERVICING

BACKGROUND OF THE INVENTION

1. Field of the Invention

The present invention relates generally to ink-jet printing and writing instrument servicing, and more specifically to a method for servicing ink-jet printhead nozzles.

2. Description of Related Art The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal,* Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in *Output Hardcopy* [sic] Devices, chapter 13 (Ed. R. C. Durbeck and S. Sherr, Academic Press, San Diego, 1988).

FIG. 1 (PRIOR ART) depicts an ink-jet hard copy apparatus, in this exemplary embodiment a computer peripheral printer, 101. A housing 103 encloses the electrical and mechanical operating mechanisms of the printer 101. Operation is administrated by an electronic controller 102 (usually a microprocessor or application specific integrated circuit ("ASIC") controlled printed circuit board) internally connected by appropriate cabling 104 and by input/output ports to a computer (not shown). It is well known to program and execute imaging, printing, print media handling, control functions and logic with firmware or software instructions for conventional or general purpose microprocessors or with ASIC's. Cut-sheet print media 105, loaded by the end-user onto an input tray 107, is fed by a suitable paper-path transport mechanism (not shown) to an internal printing station, or "print zone," where graphical images or alphanumeric text are created. A carriage 109, mounted on a slider 111, scans the print medium. An encoder 113, or other tracking device, is provided for keeping track of the position of the carriage 109 at any given time. A set 115 of one or more individual writing instruments 117A–117D, such as ink-jet pens or print cartridges, are releasable mounted in the carriage 109 for easy access (generally, in a full color system, inks—or other equivalent colorant, toner, or the like—for the subtractive primary colors, cyan, yellow, magenta (CYM) and true black (K) are provided). Once a printed page is completed, the print medium is ejected onto an output tray 119. In the state of the art, a printer 101 can have a variety of print modes related to the quality of the output desired by the end-user or to a specific print medium in use, e.g., plain paper, transparencies, photographic paper, and the like. Printing is accomplished generally by scanning and firing ink droplets; a unidirectional scan across the page is referred to as a sweep; the height of the writing instrument, e.g, from less than an inch to a full-page high nozzle array, determines the printed swath height of a given sweep.

Print cartridges are generally fully self-contained inking units intended for one-time use and replacement. Ink-jet pens are inking units which separate semi-permanent printhead mechanisms from the ink supply either by having an ink reservoir (not shown) off-axis from the pen coupled thereto by appropriate fluidic linkage, or a separate, snap-on or press-fit, ink supply for each pen. Pens tend to be constructed to use free-ink in a contained but unencumbered liquid form rather than in a saturated material such as polyurethane foam used in some print cartridges to facilitate the repeated ink supply replacements. In both cartridges and pens, their printheads generally require a mechanism to prevent the free flow of ink through the arrays of nozzle orifices thereon when the printhead is not activated. Without such control, ink may leak, or "drool," onto the printing surface or into the printer mechanism. Such leaking ink may also build up and cake onto the printhead itself, impairing proper operation.

Complex pen service stations are often provided as part of the hard copy apparatus where printheads are capped to prevent drooling and caking when not printing. The service station devices are generally located off to one side of the print zone of the apparatus (see e.g., FIG. 1, arrow 121). The printhead nozzles also can be wiped or activated to "spit" away excess ink into a spittoon and clear the nozzles while in the service station. [Service stations and their multifunctional operations are generally described in the literature and patents, such as the common assignee's U.S. Pat. No. 4,853,717, incorporated herein by reference.] Most printers have a regularly timed spit that occurs at the same interval regardless of the printing operation in progress. Generally, a simple countdown timer is started when a pen is decapped; when the timer has run-out, an interrupt signal is sent to the printing controls and the pen is returned to the service station to spit all nozzles.

A common modification of the fixed spit interval is to signal for a service interrupt when the printhead is not otherwise engaged, e.g., while the printer is loading a next sheet of print medium. When printing of the new sheet is initiated, the fixed spit timer is reset.

In some print modes, e.g., a DRAFT mode, throughput is more important than quality. In other print modes, e.g., a HIGH DEFINITION PHOTO mode, print quality is paramount with less emphasis on total page printing time for the current page. Such print quality modalities can be taken into account for varying the time between service spitting the nozzles, e.g., lengthening the interval in a DRAFT mode. The commonly used timed spit interval can be modified even within a print mode to improve throughput and to avoid print defects. For example, the timer may signal for a spit while the printhead is printing on the side of a page distal from the service station; the control logic permits the print of the sweep which repositions the printhead until the carriage has returned the side of a page proximate the service station. Moreover, some print modes, such as multi-pass print swaths, are especially sensitive to the ink drop firing order and timing. To avoid service pause related defects, the control logic may over-ride a service time-out until a printing pause opportunity occurs; e.g., on a multiple photographic image page, between the end of one image and the start of the next. However, depending on the ink formulations, the simple countdown timer methodology does not address variations in decap performance between inks, e.g., there may be a disparity between the length of time yellow ink may spend decapped without printing and the length of time for cyan ink. The problem is even more egregious in documents such as business graphics which tend to have both regions of text and color graphics or ink-jet printed photographs on the same page.

Another problem is known as wait banding, which occurs when pauses in a printing routine results in a sweep where wet colorant and dry colorant overlap. This then appears as a print artifact of either a value or hue shift in a single band across the page.

Thus, there is a need for a method of service spitting for ink-jet printheads which addresses the needs of each ink formulation and which addresses individual needs of each print mode available in the specific printer.

SUMMARY OF THE INVENTION

In its basic aspects, the present invention provides a document dependent servicing methodology. Service spitting, or other printhead cartridge servicing, is based on an algorithm that is integrally tied to the print mode and on what inks have been fired recently during the current print mode. More particularly, the present invention provides a method for servicing of ink-jet printhead nozzles of at least one ink-jet writing mechanisms for firing ink droplets onto an adjacent print medium, the writing mechanisms having a plurality of inks wherein each of the inks is an individually available ink. The method includes the steps of: setting a fail-safe mechanisms for timing to a predetermined fail-safe value; and separately for the each individually available ink, determining if a next swath of printing requires firing ink drops of a particular one of the each individually available ink, determining if the next swath of printing would be greater than a predetermined interval since firing the particular one of the each individually available ink to be used in the next swath of printing, and if the next swath of printing would be greater than the predetermined interval since firing of the particular one of the each individually available ink to be used in the next swath of printing or if the fail-safe value is exceeded, triggering the servicing.

In another basic aspect, the present invention provides a look-ahead method for printing with an ink-jet hard copy apparatus, the apparatus including at least one ink-jet writing instrument having at least one printhead for firing ink droplets of a plurality of selectable inks from a plurality of respectively coupled ink-jet nozzles onto adjacent print media transported by the apparatus to a print zone therein. The method includes the steps of: receiving printing data; determining a type of print medium to be printed with the data; determining a print quality to be achieved in printing the data; setting a periodic timer to a predetermined value determinative of each next servicing the at least one ink-jet writing instrument wherein the servicing includes spitting ink from each of the nozzles; decapping and servicing the at least one ink-jet writing instrument; resetting the periodic timer and beginning a count to the predetermined value; printing a swath from the printing data by including for each of the plurality of inks and separately for the each of the inks A) determining if a next swath printing sweep requires firing ink drops of a particular one of the inks, B) determining if the next swath printing sweep would be greater than a predetermined number of sweeps since firing the particular one of the inks to be used in the next swath printing sweep, and C) if the next swath printing sweep would be greater than a predetermined number of sweeps since the firing of the particular one of the inks to be used in the next swath printing sweep, or if the fail-safe time is exceeded, triggering a decap servicing of the nozzles before printing the next swath or D) if the next swath printing sweep would not be greater than a predetermined number of sweeps since the firing of the particular one of the inks to be used in the next swath printing sweep, and if the fail-safe time is not exceeded, printing the next swath.

In another basic aspect, the present invention provides an ink-jet printer, having ink-jet writing instruments and service station mechanisms for capping and for printhead service spitting of ink from the writing instrument, the writing instruments providing a plurality of separately available individual inks for writing on an adjacently positioned print medium, each of the inks having a predetermined DECAP TIME, the printer further including: a fail-safe timer selectively settable to a fail-safe value greater than a longest DECAP TIME for each of the separately available individual inks; for the each of the separately available individual inks, mechanisms for determining if a next swath printing sweep requires firing ink drops of a particular one of the separately available individual inks and mechanisms for determining if the next swath printing sweep would be greater than a predetermined number of sweeps since firing the particular one of the separately available individual inks to be used in the next swath printing sweep; mechanisms for triggering a decap servicing of the nozzles if the next swath printing sweep would be greater than a predetermined number of sweeps since the firing of the particular one of the separately available individual inks to be used in the next swath printing sweep or if the fail-safe value is exceeded; and mechanisms for printing the next swath if the next swath printing sweep would not be greater than a predetermined number of sweeps since the firing of the particular one of the separately available individual inks to be used in the next swath printing sweep and if the fail-safe value is not exceeded.

In another basic aspect, the present invention provides a computer memory having a program for servicing an ink-jet printhead of at least one ink-jet writing instrument, including: mechanisms for setting a fail-safe timer to a value greater than a predetermined longest DECAP TIME for separately available individual inks of the at least one ink-jet writing instrument; and separately for the each individually available ink fired by the printhead, mechanisms for determining if a next swath of printing requires firing ink drops of a particular one of the each individually available ink and mechanisms for determining if the next swath of printing would be greater than a predetermined interval since last firing the particular one of the each individually available ink to be used in the next swath printing sweep, and mechanisms for servicing the nozzles wherein if the next swath of printing would exceed the interval or if the fail-safe timer value is exceeded, triggering a servicing of the nozzles with the mechanisms for servicing is implemented.

It is an advantage of the present invention that it automatically provides for service spitting for ink-jet printheads which addresses the needs of each ink formulation.

It is an advantage of the present invention that it provides for service spitting for ink-jet printheads which addresses individual needs of each print mode available in the specific hard copy apparatus implementation.

It is an advantage of the present invention that it increases throughput performance of hard copy apparatus in which it is implemented.

It is a further advantage of the present invention that it ameliorates the problem of ink-jet nozzle clogging.

It is another advantage of the present invention that it can be implemented in a downloadable computer program format and thus be used to retrofit an installed base.

It is another advantage of the present invention at wait banding is reduced.

It is yet another advantage of the present invention that it can be adapted for other types of writing instrument servicing, such as wiping.

The foregoing summary and list of advantages is not intended by the inventors to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprize the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

BRIEF DESCRIPTION OF THE DRAWINGS

FIG. 3 is a table showing exemplary real-data for the LAS as shown in FIGS. 2A–2C.

The drawings referred to in this specification should be understood as not being drawn to scale except if specifically noted.

DESCRIPTION OF THE PREFERRED EMBODIMENT

Reference is made now in detail to a specific embodiment of the present invention which illustrates the best mode presently contemplated by the inventors for practicing the invention. Alternative embodiments are also briefly described as applicable. The present invention may be implemented in software or firmware in accordance with state of the art hard copy apparatus technology.

Figure 1:
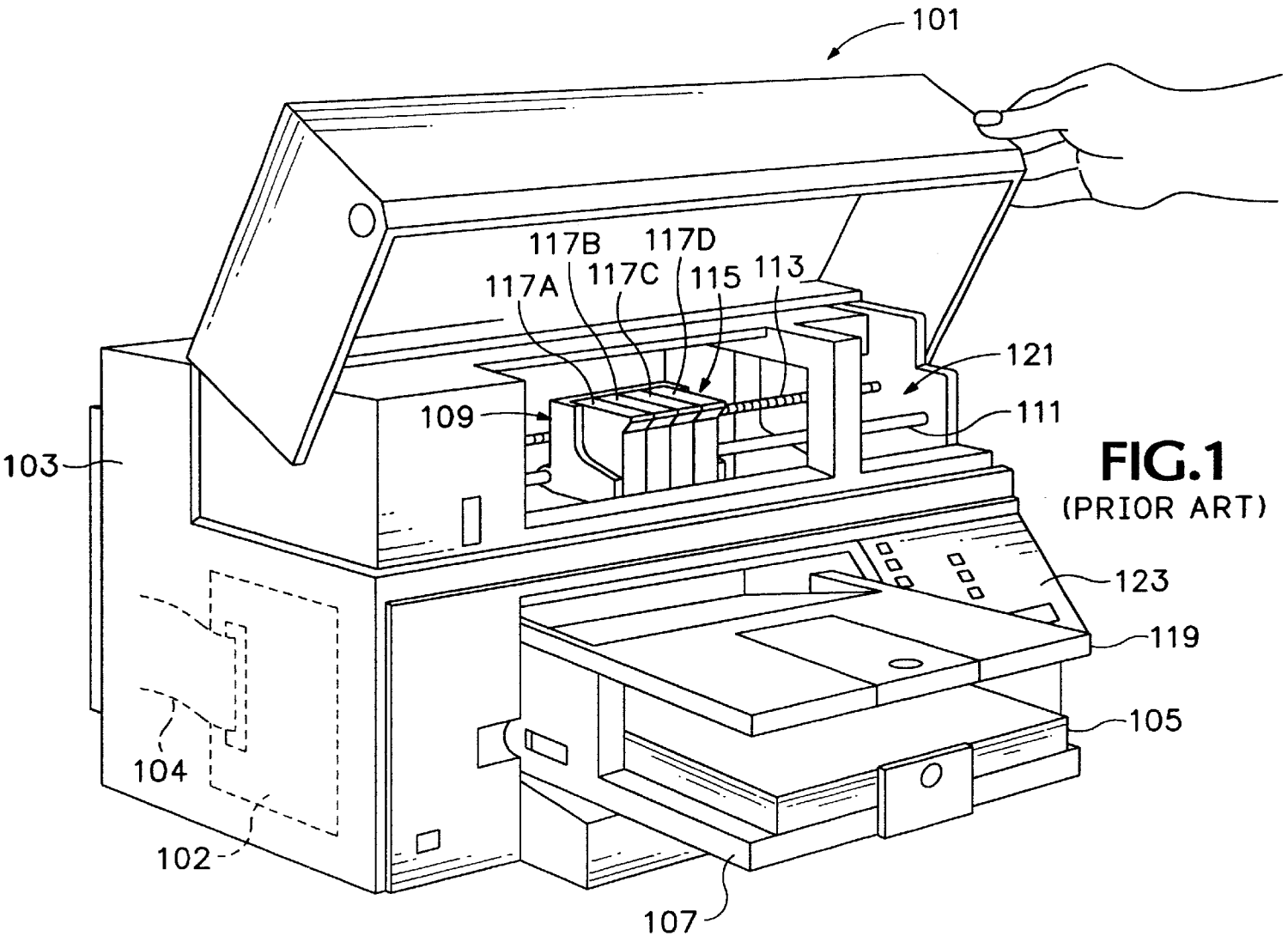
FIG.1 (PRIOR ART)
FIG. 1 (Prior Art) depicts an exemplary embodiment of an ink-jet printer for use in accordance with the present invention.
Figure 2A:
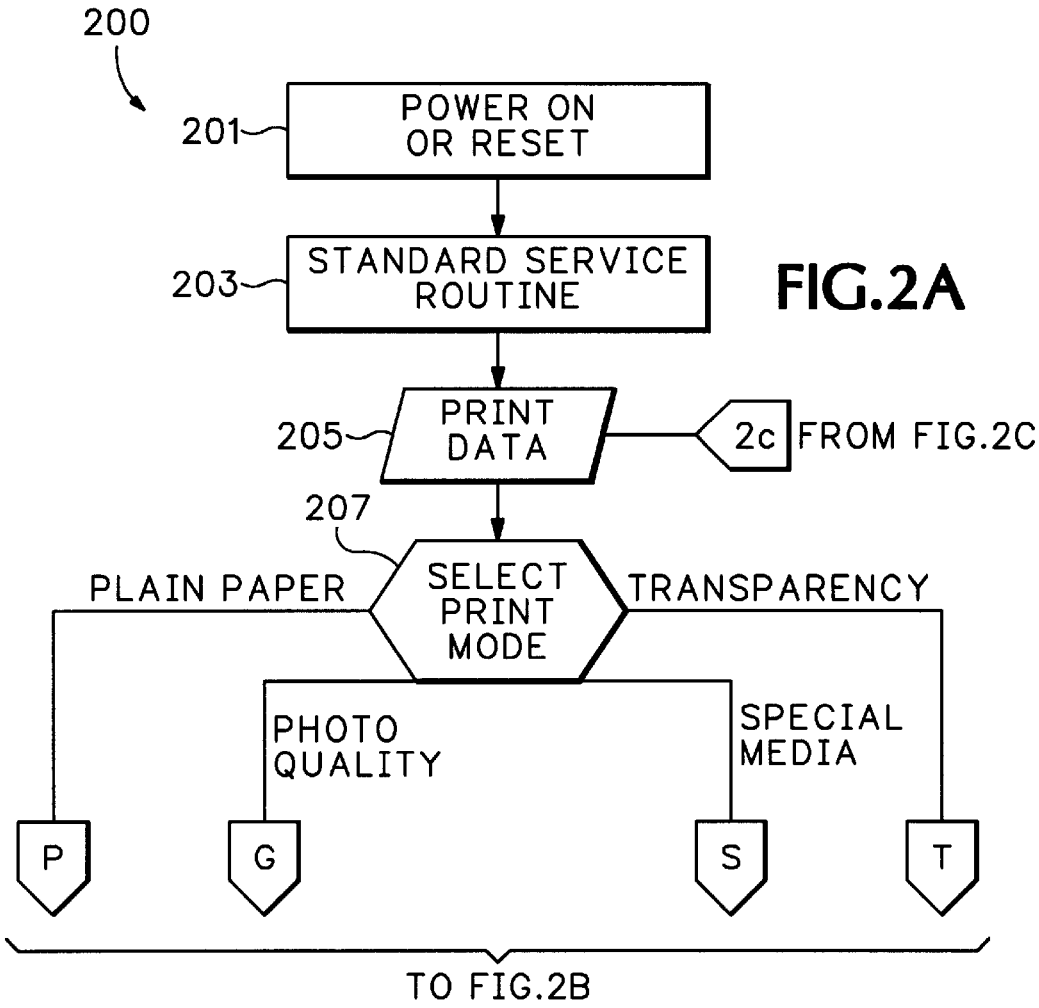
FIGS. 2A through 2C are a flow chart for a look-ahead servicing, or spitting, ("LAS") algorithm in accordance with the present invention.
Figure 2B:
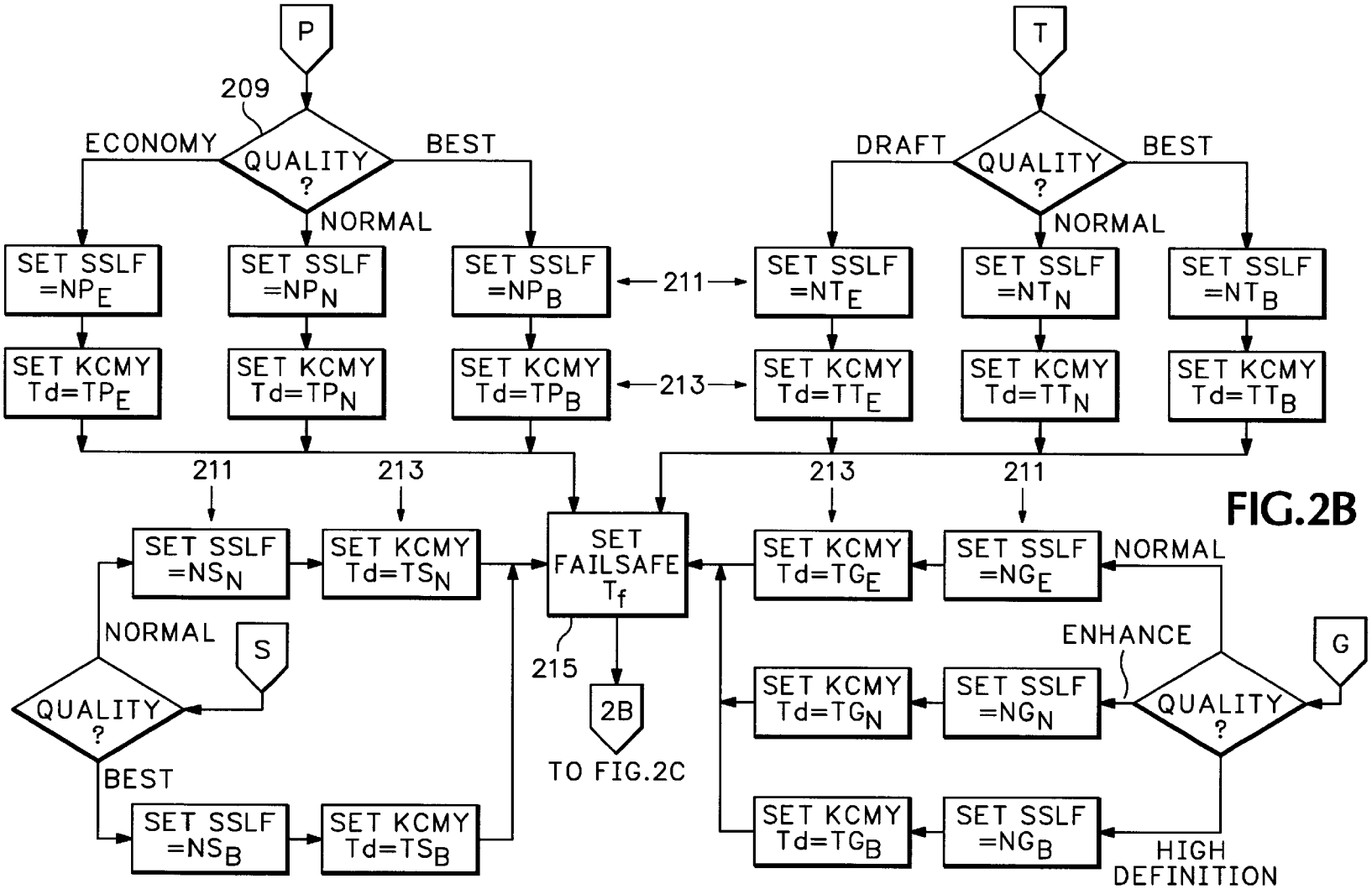
Figure 2C:
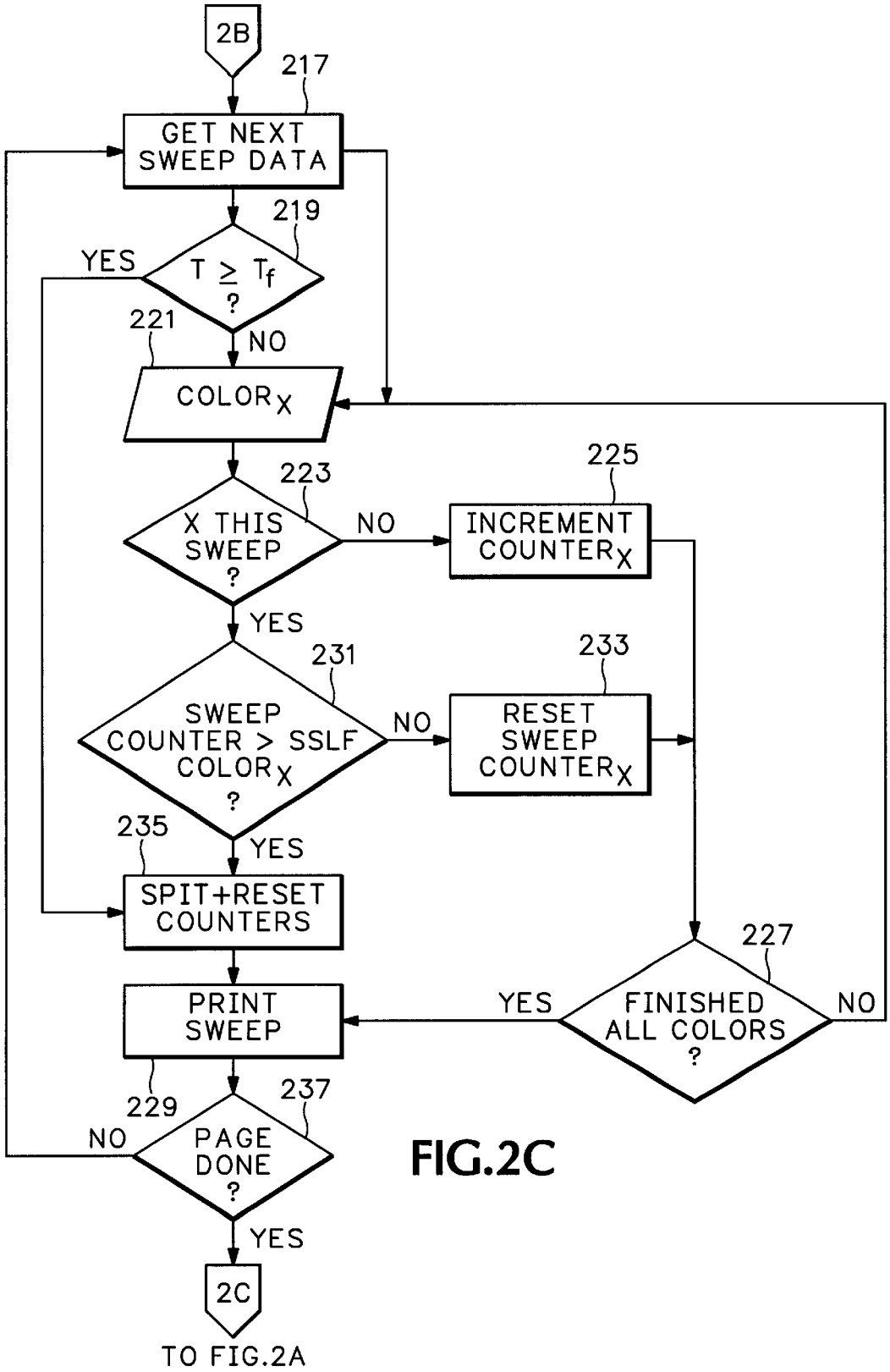

FIGS. 2A through 2C presents an exemplary servicing embodiment of the methodology of the present invention, referred to hereinafter generically as the "look ahead spit" ("LAS") program or simply "the LAS." Referring also to FIG. 1 as representative of hard copy apparatus hardware compatible with the present invention, the LAS is loaded into the controller 102 and resides in a component, such as an electrically programmable read only memory (not shown), therein.

When a printer 101 is turned on, or reset by the end-user, STEP 201, it is known in the art to perform a pen service routines, STEP 203, which includes a spitting from all nozzles after which the pens are either recapped and parked at the service station 121 until a printing operation is initiated or a printing operation is immediately initiated. It will also be recognized by those skilled in the art that these standard service routines, STEP 203, may generate interrupts during printing operations, including interrupting the LAS algorithm explained hereinafter, for a variety of known ink-jet related operational conditions. Thus, the location of STEP 203 at this point in the flowchart of FIG. 2A will be recognized as for convenience only.

A printing operation is initiated by a computer application program sending print data 205. Generally it is known to have the print data 205 include information to automatically set the print mode, have the device driver set the print mode, or to have the end user select a print mode using the hardware front panel controls 123, STEP 207. Exemplary print media modes related to the type of print media being employed for the current printing operation are shown in FIG. 2A as:

PLAIN PAPER, or "P,"

PHOTO QUALITY, or "G," (for "glossy"),

TRANSPARENCY, or "T," and

SPECIAL MEDIA, or "S."

Other print media modes can be provided in accordance with any specific implementation and no limitation on the scope of the invention is intended by the inventors nor should any such limitation be implied from these exemplary print media modes.

As an example of the method of operation of the LAS, along the PLAIN PAPER path, "P," after selection of print mode, step 207, a determination as to the print quality mode is established, STEP 209. Exemplary print quality modes are shown, again without limitation, in FIG. 2B as:

ECONOMY (also commonly referred to in the art as DRAFT) mode,

NORMAL (also commonly referred to as DEFAULT) mode, and BEST mode.

Particular implementations can establish other specific modes.

A known-manner sweep counter is provided, generally incorporated to operate in conjunction with the encoder 113 subsystem, to keep track of the number of "sweeps since last fired" ("SSLF") for each printhead. It will be recognized by a person skilled in the art, that the "counter" can also be a used which tracks "time since last fired" ("TSLF"); this description is simplified by using the exemplary SSLF model, but "counter" and "timer" are used interchangeably and specific designs can be tailored to commercial implementations as desired.

Each printhead is provided with a predetermined characteristic number of sweeps, "N," related to various design criteria for a specific printhead and the related ink formulations. That is, for each printhead mechanism and ink formulation, optimal numbers of sweeps without servicing can be determined. Turning briefly to FIG. 3, section 301, shows a specific exemplary embodiment for a black, "K," cyan, "C," magenta, "M," and yellow, "Y" inks SSLF values for a variety of print media modes 303, print quality modes 305 and carriage velocities 307. These values are collectively referred to as the "sweep triggers. "

For the forthcoming printing operation, the appropriate SSLF N-value is set, for path P being designated "NP", STEP 211. For example, for path P. in an ECONOMY mode, for each printhead/ink combination $$NP_E=NP_1=150K:60_C:60_M;\text{ and }50_Y, \quad \text{(Equation 1)}$$

or, for path P, NORMAL mode, $$NP_N=NP_2=25_K:20_C:20_M;\text{ and }10_Y, \quad \text{(Equation 2)}$$

or, for path P, BEST mode, $$NP_B=NP_3=15_K:15_C:15_M;\text{ and }7_Y. \quad \text{(Equation 3)}$$

Thus, the faster the carriage speed, $NP_n$ or the lower the print quality mode, $NP_{E/N/B}$, the longer the SSLF value, or $$NP_1>NP_2>NP_3 \quad \text{(Equation 4)}$$

or $$NP_E>NP_N>NP_B \quad \text{(Equation 5).}$$

That is, the faster the carriage or lower the print quality mode, the more sweeps between servicing.

Looking back to FIG. 2B, it can now be recognized that for the other individual print media paths, T, S, and G, the same setting of appropriate SSLF N-values, STEP 211, viz., $NT_x$, $NS_x$ or $NG_x$, occurs, dependent upon what print media has been selected, STEP 207. Note that in accordance that with classic terminology of the industry ECONOMY mode may also be referred to as DRAFT mode and with respect to photo-reproduction other synonyms like ENHANCED or HIGH DEFINITION are employed, but essentially the Equations are the same. Moreover, there may be only one print mode or more than three print quality modes provided.

Next, STEP 213, based on printhead technology and the known ink formulation of a specific embodiment, each $pen_{KCMY}$ will have an empirically determined DECAP TIME, "Td," as exemplified in FIG. 3. That is, it will be known what is the design tolerance time in seconds that a printhead should remain uncapped without firing the nozzles before a servicing of the nozzles is recommended. In the exemplary embodiment, knowing the DECAP TIME 309 in seconds and the carriage speed (ips) and sweep duration in seconds/sweep, the "sweeps since last firing" value can be determined:

$$SSLF = \text{DECAP TIME} + \text{sweep duration} \quad \text{(Equation 6).}$$

Again, to generalize, for the various print quality modes:

$$Td = TP_E > TP_N > TP_B \quad \text{(Equation 7),}$$

depending on which quality mode path is selected (i.e., substituting $TT_x$, or $TS_x$ or $TG_x$ as shown in FIG. 2B).

In summary, along whichever path has been designated, a sweep timer, namely a SSLF timer is set for each color ink.

Next, STEP 215, a "fail-safe" time, "Tf," is designated and a fail-safe timer set. Generally, this default-based interrupt is triggered no matter what is in the document with respect to ink usage if it is desired to over-ride the IAS system. Thus, generally, it is set to be greater than the largest DECAP TIME 309; i.e., $$Tf > Td_{maximum} \quad \text{(Equation 8).}$$

In the alternative, rather than calculating a fail-safe time for each print media mode and print quality mode, Tf may simply be a predetermined constant for the particular hard copy apparatus design implementation. Note that by setting the Tf to be very high on susceptible media—namely glossy types—the number of decap, flying spits can be reduced or eliminated. This will reduce or eliminate wait banding.

With each color sweep counter 211 and fail-safe time 215 set, printing is commenced as shown in FIG. 2C. The "next sweep" data set is buffered in a known manner, STEP 217, becoming the "current sweep," and the fail-safe timer is checked, STEP 219. As would be known in the art, a fail-safe timer actually will run in parallel with printing operations and will issue an interrupt to the printing algorithm if and when Tf is exceeded; it is referenced at this step merely for convenience of explaining the present invention.

Assuming the current time is less than Tf, sequentially for each color pen data set 221, a determination is made, STEP 223, whether the next color, COLORx, to be printed by the printing algorithm is going to be used in the current sweep. If not (223, NO-path), the counter of SSLF for that color is incremented by one, STEP 225. A determination is made as to whether COLORx is the last available color, STEP 227. If not (227, NO-path), the routine loops back to obtain the next color ink. If it was the last available color (227, YES-path), the current sweep is printed, STEP 229.

Note that for an all one color current page, such as a simple page of text, a default can be set to ignore this color check loop and increase throughput.

Returning to STEP 223, the determination of whether the current COLORx, is to be printed by the printing algorithm is going to be used in the current sweep, if the answer is YES, a determination is made, STEP 231, as to whether the sweep counter 211 has exceeded the SSLF 301 for the current COLORx. If not (231, NO-path), that SSLF timer count is reset, STEP 233, and the next COLORx checked via the loop 227, NO-path. If the last sweep exceed the SSLF value for the current COLORx (231, YES-path), the pen is returned to the service station for spit servicing of the printheads, at which time the counters 211, 215 are reset, STEP 235.

Following such a printhead spit servicing, the current sweep can be printed, STEP 229. After the current sweep is printed, a determination is made whether it was the last swath of the page, STEP 237. If not (237, NO-path), the next sweep data set is obtained, STEP 217. If the page is finished (237, YES-path), the next set of print data is downloaded, STEP 205, FIG. 2A.

So, in summary, if the next sweep contains the next color in the pen or printhead set, and the next sweep would be greater than this number of sweeps since the last firing of that color ink - whether on page or at the service station—and the last sweep did not fire droplets of the color, a decap service spit is triggered. All service calls spit fire all nozzles, so all timer values are reset whenever at a service spit. Reaching or exceeding the fail-safe limit Tf similarly triggers a decap service spit.

It will be recognized by those skilled in the art that Sweeps Since Last Firing may be otherwise expressed and determined, such as a Time Since Last Firing or other determinative interval. Also, it will again be recognized by those skilled in the art that known manner interrupts for standard service routines, step 203, also occur during operation as provided for in a specific implementation, e.g., job start-stop boundaries, page start-stop boundaries, between sweeps, during quiescent modes, and the like. The LAS timers are thus reset accordingly.

Moreover, the methodology of the present invention can be expanded to monitor each nozzle of each printhead; that is, rather than monitoring primitive sets—see FIG. 3, "# UNIDI SWEEPS SINCE LAST SPIT" —each nozzle, K1, K2. . . K300, C1, C2. . . C300 et seq., is monitored for SSLF. For example, a print job might run for a period firing nozzles C1 and C3, then request nozzle C2; a check for the C2 SSLF is checked and if the threshold exceeded, a service spit initiated first.

Thus, the present LAS methodology solves the problems associated with nozzle clogging and improves hard copy apparatus throughput.

The foregoing description of the preferred embodiment of the present invention has been presented for purposes of illustration and description. It is not intended to be exhaustive or to limit the invention to the precise form or to exemplary embodiments disclosed. obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents.

What is claimed is:

1. A method for servicing of ink-jet printhead nozzles of at least one ink-jet writing means for firing ink droplets onto an adjacent print medium, the writing means having a plurality of inks wherein each of the inks is an individually available ink, the method comprising:

setting a fail-safe means for timing to a predetermined fail-safe value; and separately for the each individually available ink, determining if a next swath of printing requires firing ink drops of a particular one of the each individually available ink, determining if the next swath of printing would be greater than a predetermined interval since firing the particular one of the each individually available ink to be used in the next swath of printing, and if the next swath of printing would be greater than the predetermined interval since firing of the particular one of the each individually available ink to be used in the next swath of printing or if the fail-safe value is exceeded, triggering the servicing.

2. The method as set forth in claim 1, the setting a fail-safe means for timing to a predetermined fail-safe value comprising:

the predetermined fail-safe value is greater than a predetermined longest decap interval for the plurality of inks.

3. The method as set forth in claim 1 further comprising:

if a next swath of printing does not require firing ink drops of a particular one of the each individually available ink, incrementing a means for tracking last firing of the particular one of the each individually available ink.

4. The method as set forth in claim 3 further comprising:

if a next swath of printing does require firing ink drops of a particular one of the each individually available ink and the means for tracking has not exceed the predetermined interval, resetting the means for tracking for the particular one of the each individually available ink.

5. The method as set forth in claim 3, the triggering a decap servicing of the nozzles further comprising:

resetting the means for tracking and the means for timing.

6. The method as set forth in claim 1 further comprising:

calculating the predetermined interval from a given predetermined decap time for each individually available ink and a given predetermined duration for printing a swath.

7. The method as set forth in claim 6 further comprising:

for each individually available ink, calculating the means for tracking as a function of a print quality characteristic in accordance with the equation:

$$SSLF = \text{decap time} + \text{sweep duration},$$

where SSLF means sweeps since last firing.

8. The method as set forth in claim 7, the calculating further comprising:

the given predetermined sweep duration is a function of carriage speed and print zone width and the carriage speed is selected as a function of print quality.

9. The method as set forth in claim 8 wherein the print quality is dependent upon print medium type.

10. The method as set forth in claim 6, wherein the setting a fail-safe time, Tf, further comprises:

calculating the fail-safe time in accordance with the equation:

$$Tf > \text{maximum decap time},$$

where the maximum decap time is selected as a largest predetermined decap time for the inks.

11. A look-ahead method for printing with an ink-jet hard copy apparatus, the apparatus including at least one ink-jet writing instrument having at least one printhead for firing ink droplets of a plurality of selectable inks from a plurality of respectively coupled ink-jet nozzles onto adjacent print media transported by the apparatus to a print zone therein, the method comprising:

receiving printing data;

determining a type of print medium to be printed with the data;

determining a print quality to be achieved in printing the data;

setting a periodic timer to a predetermined value determinative of each next servicing the at least one inkjet writing instrument wherein the servicing includes spitting ink from each of the nozzles;

decapping and servicing the at least one ink-jet writing instrument;

resetting the periodic timer and beginning a count to the predetermined value;

printing a swath from the printing data by including for each of the plurality of inks and separately for the each of the inks A) determining if a next swath printing sweep requires firing ink drops of a particular one of the inks, B) determining if the next swath printing sweep would be greater than a predetermined number of sweeps since firing the particular one of the inks to be used in the next swath printing sweep, and C) if the next swath printing sweep would be greater than a predetermined number of sweeps since the firing of the particular one of the inks to be used in the next swath printing sweep, or if the fail-safe time is exceeded, triggering a decap servicing of the nozzles before printing the next swath, or D) if the next swath printing sweep would not be greater than a predetermined number of sweeps since the firing of the particular one of the inks to be used in the next swath printing sweep, and if the fail-safe time is not exceeded, printing the next swath.

12. The method as set forth in claim 11, step B) further comprising:

separately each of the inks,

E) setting a sweep counter for tracking the number of sweeps since a respective one of each of the inks was fired from the nozzles, F) determining if a first of the inks is used in a next swath sweep of the ink-jet writing instrument, and if not, incrementing the counter for tracking the number of sweeps since the first of the inks was fired from the nozzles, and repeating steps B) through D) for a next of the inks, or if so, determining if the sweep counter for the first of the inks exceeds a predetermined count for the first of the inks, and if not, resetting the sweep counter for the first of the inks, and repeating step A) through D) for a next of the inks, or if so, servicing the writing instrument and printing the swath; and repeating steps A) through F) for each swath sweep.

13. The method as set forth in claim 12, wherein the triggering a decap service spit further comprises:

separately for each of the inks, service spit firing of all printhead nozzles, and resetting the periodic timer and the sweep counter.

14. The method as set forth in claim 11 further comprising:

repeating the steps for each swath of a page.

15. The method as set forth in claim 11, the determining if the next swath printing sweep would be greater than a predetermined number of sweeps since firing, SSLF, the particular one of the inks to be used in the next swath printing sweep, further comprising:

determining SSLF as a function of type of print medium employed for the printing, selected print quality mode of printing on the print medium, and predetermined DECAP TIME for each of the inks, where print quality mode is a function of inkjet writing sweep duration across a page to be printed.

16. The method as set forth in claim 15 further comprising:

calculating SSLF for each particular one of the inks in accordance with the equation:

$$SSLF = \text{DECAP TIME} + \text{sweep duration}.$$

17. The method as set forth in claim 16 further comprising:

providing at least two selectable print quality modes wherein the DECAP TIME for a greater print quality mode is progressively less than the DECAP TIME for each lesser print quality mode.

18. The method as set forth in claim 17, wherein the setting periodic timer to a predetermined count for servicing further comprises:

calculating a fail-safe time, Tf, in accordance with the equation:

$$Tf > \text{DECAP TIME max},$$

where DECAP TIME max is selected as a largest DECAP TIME for inks for a currently selected print quality mode.

19. The method as set forth in claim 16 further comprising:

monitoring each individual nozzle with respect to the SSLF.

20. An ink-jet printer, having ink-jet writing instruments and a service station means for capping and for printhead service spitting of ink from the writing instrument, the writing instruments providing a plurality of separately available individual inks for writing on an adjacently positioned print medium, each of the inks having a predetermined DECAP TIME, the printer further comprising:

a fail-safe timer selectively seftable to a fail-safe value greater than a longest DECAP TIME for each of the separately available individual inks;

for the each of the separately available individual inks, means for determining if a next swath printing sweep requires firing ink drops of a particular one of the separately available individual inks and means for determining if the next swath printing sweep would be greater than a predetermined number of sweeps since firing the particular one of the separately available individual inks to be used in the next swath printing sweep; and means for triggering a decap servicing of the nozzles if the next swath printing sweep would be greater than a predetermined number of sweeps since the firing of the particular one of the separately available individual inks to be used in the next swath printing sweep or if the fail-safe value is exceeded; and means for printing the next swath if the next swath printing sweep would not be greater than a predetermined number of sweeps since the firing of the particular one of the separately available individual inks to be used in the next swath printing sweep and if the fail-safe value is not exceeded.

21. The printer as set forth in claim 20, comprising:

for each of the separately available individual inks, means for counting number of sweeps since last firing of the particular one of the each of the separately available individual inks wherein if a next swath printing sweep does not require firing ink drops of a particular one of the each of the separately available individual inks, the means for counting for tracking number of sweeps is incremented.

22. The printer set forth in claim 21, comprising:

if a next swath printing sweep does require firing ink drops of a particular one of the each of the separately available individual inks, and the means for counting has not exceed the predetermined number of sweeps since the firing of the particular one of the each of the separately available individual inks to be used in the next swath printing sweep, the means for counting for the particular one of the each of the separately available individual inks is reset.

23. The printer set forth in claim 22, comprising:

means for interrupting for periodically performing known manner servicing of the writing instruments.

24. A computer memory having a program for servicing an ink-jet printhead of at least one ink-jet writing instrument, comprising:

means for setting a fail-safe timer to a value greater than a predetermined longest DECAP TIME for separately available individual inks of the at least one ink-jet writing instrument; and separately for the each individually available ink fired by the printhead, means for determining if a next swath of printing requires firing ink drops of a particular one of the each individually available ink and means for determining if the next swath of printing would be greater than a predetermined interval since last firing the particular one of the each individually available ink to be used in the next swath printing sweep, and means for servicing the nozzles wherein if the next swath of printing would exceed the interval or if the fail-safe timer value is exceeded, triggering a servicing of the nozzles with the means for servicing is implemented.

25. The invention as set forth in claim 24, comprising:

means for incrementing a counter for tracking number of sweeps since last firing of the particular one of the each individually available ink if a next swath printing sweep does not require firing ink drops of a particular one of the each individually available ink.

26. The invention as set forth in claim 25, comprising:

means for resetting the counter for the particular one of the each individually available ink if a next swath printing sweep does require firing ink drops of a particular one of the each individually available ink and the sweep counter has not exceed the predetermined number of sweeps since the firing of the particular one of the each individually available ink to be used in the next swath printing sweep.

27. The invention as set forth in claim 26, the means for servicing of the nozzles further comprising:

means for resetting the counter and the timer.

28. The invention as set forth in claim 27, wherein the means for setting a fail-safe time, Tf, further comprises:

means for calculating the fail-safe time in accordance with the equation:

$$Tf > \text{DECAP TIME max},$$

where DECAP TIME max is selected as a largest DECAP TIME for each individually available ink.

29. The invention as set forth in claim 24, comprising:

means for calculating the predetermined number of sweeps from a given predetermined DECAP TIME for each individually available ink and a given predetermined sweep duration for printing a swath.

30. The invention as set forth in claim 29, further comprising:

means for calculating for each individually available ink a timer characteristic defined by sweep duration for a predetermined print zone width divided by a predetermined writing instrument carriage speed across the print zone.

31. The invention as set forth in claim 30, comprising the step of:

the carriage speed is selected as a function of print quality mode selected.

32. The invention as set forth in claim 31, comprising the step of:

the print quality is dependent upon print medium type.

* * * * *